US005657608A

United States Patent [19]

Parviainen et al.

[11] Patent Number: 5,657,608

[45] Date of Patent: Aug. 19, 1997

[54] METHOD AND AN APPARATUS FOR WRAPPING OF AN ARTICLE

[75] Inventors: Ossi Heikki Juhani Parviainen, Kuopio; Kai Petri Parni, Vuorela, both of Finland

[73] Assignee: Innocomp Automaatio Oy, Kuopio, Finland

[21] Appl. No.: 590,763

[22] Filed: Jan. 24, 1996

[51] Int. Cl.[6] ..... B65B 49/10; B65B 51/02

[52] U.S. Cl. ..... 53/66; 53/210; 53/465

[58] Field of Search ..... 53/465, 461, 66, 53/64, 210, 220, 226, 168, 389.3, 389.2

[56] References Cited

U.S. PATENT DOCUMENTS

| | | | |
|---|---|---|---|
| 2,762,176 | 9/1956 | Knapp et al. | 53/66 |
| 3,196,591 | 7/1965 | Guido et al. | 53/66 X |
| 3,499,263 | 3/1970 | Stanley et al. | 53/210 |
| 3,504,476 | 4/1970 | Ehrenfried et al. | 53/210 X |
| 3,996,728 | 12/1976 | Gentili | 53/66 X |

FOREIGN PATENT DOCUMENTS

| | | |
|---|---|---|
| 923272 | 7/1992 | Finland . |

*Primary Examiner*—James F. Coan
*Attorney, Agent, or Firm*—Browdy and Neimark

[57] ABSTRACT

The present invention relates to a method and an apparatus (10) for wrapping of an article. The apparatus comprises backing means (20) adapted to be moved against the first and second ends of the article and simultaneously to dispose a wrapper material against said ends. After said wrapper material is disposed against the first end the article is moved relative to the wrapping station and a web-like wrapper material roll (13) thereof such that wrapper material emerges simultaneously from the roll on the top of the article. First folding means (26) are arranged to fold the portions of the wrapper material extending over the width of the first end of the article against the sides. As the second end of the article reaches the backing means (20), said second end is correspondingly engaged with a second surface (21) of the backing means such that the wrapper material becomes disposed between said surface and said second end. The wrapper material web is then cut, and the portions thereof extending over the width of said second end are subsequently folded against the sides of the article by second folding means (28). The side portions of the wrapper extending over the width of the article on the top thereof are disposed against the sides of the article, whereby the wrapper is finished.

20 Claims, 6 Drawing Sheets

METHOD AND AN APPARATUS FOR WRAPPING OF AN ARTICLE

BACKGROUND OF THE INVENTION

The present invention relates to a method for wrapping of an article such as a bundle of lumber, plywood or chipboard, or a pile of other articles, for instance, articles used in construction work, or a paper or pulp bale or a similar essentially parallepipedly shaped article. The invention relates further to an apparatus realizing the inventive method.

It is prior known to wrap or envelop articles having an essentially orthogonal form, such as bundles of lumber, pulp or similar, from the five sides thereof by suitable wrapping material. In most cases this is done to protect the articles, for instance to give a protection to them during the transportation and storage. In addition, the wrapper sheet provides a solid surface for various marking, identifiers and labels or even for commercial advertisements. The wrapper may also be used to give the articles a neater appearance, and to hide some details of the wrapped material which are not intended to be seen by the public.

The placement and folding of the wrapper sheet is usually a manual or semi-automatic operation, whereby a web like wrapper material has been supplied from a material roll positioned above the article to be wrapped. The article might be placed on a conveyor, and the wrapper is drawn from the roll on top of the article as the article passes by the roll. As the rear end of the article has passed the material roll, the material web is cut by manual or semi-automatic means. Then the wrapper material is folded manually i.e. by hand around the article. The attachment of the wrapper foldings or tongues, which may be effected by gluing, taping, riveting, and the other possible stages, such as stages for setting various plastic or steel bands around the package has been correspondingly performed manually.

There are several disadvantages with the prior art wrapping arrangements. The level of automation of the prior known methods and apparatus is low, and thus several workers are required when folding and attaching the wrapper. Known wrapping arrangements are labor intensive and time-consuming to operate. Due to an excessive amount of manual handling, the quality and especially the uniformity of the packages has not met today's requirements. Furthermore, when wrapping by the present methods, it is usual that the wrapper sheet fails to become wound sufficiently tightly around the article and against the surfaces thereof, and is thus very easily ripped, for instance by an air flow penetrating between the article and the wrapper during transportation. In addition, the appearance of the manually made wrappers has not always been satisfactory. When some other means than adhesive or similar means, such as steel band or steel rivets or nails, has been used to attach the wrapper, they have caused harm and disadvantages during the further processing of the wrapped articles, for instance when sawing or chipping of deal planks or boards.

Finnish Patent Application No. 923272 discloses a method and apparatus by means of which paper pulp bales are wrapped by folding and subsequent gluing of a wrapper sheet. More precisely, said application discloses an apparatus which can be used only when essentially short parallelepiped bales, i.e. essentially cubically shaped pulp bales are wrapped. Said apparatus comprises means for folding the wrapper in the end surfaces of the bale and means for applying adhesive to the folded tongues of the wrapper prior pressing them towards the ends of the bale.

In practice, however, such paper pulp bale wrapper includes several disadvantages. The proposed apparatus folds the wrapper only in the ends of the bale, and thus the sides thereof need to be folded outside of said apparatus. Furthermore, said apparatus is constructed to bales having essentially equal dimensions, and thus can be utilized only with articles having dimensions corresponding to the set values. In addition, the apparatus according to FI application 923272 cannot be suited for articles being essentially longer than the width and height thereof is.

Therefore, it is an object of the present invention to overcome the disadvantages of the prior art arrangements and to provide a totally new type of solution for the wrapping of articles, especially articles having an essentially parallelepiped shape. The solution according to the present invention provides a simple, reliable and automatic manner for the wrapping.

Another object of the present invention is to provide a method and apparatus by means of which the wrapping of articles can be performed as a continuous process.

Still another object of the present invention is to provide a method and an automatic wrapping apparatus, by which articles having essentially different widths and/or lengths and/or heights can be wrapped.

It is also an object of the present invention to provide a wrapping device and a method in which a suitable web-like wrapper material, such as paper, board or plastic sheet is drawn from a suitable source of material, such as from a wrapper material roll, the width of said web-like material being adapted to be modified according to the dimensions of the article to be wrapped in the beginning or during the wrapping procedure.

A still further object of the present invention is to provide a method and a high-speed wrapping apparatus by means of which it is possible to provide wrappers having an uniform appearance and being tight enough to withstand the stresses caused by various handlings, such as transportation and storage.

A still further object of the present invention is to provide a method and apparatus by which even such articles, which comprise essentially irregular surfaces, and/or which comprise extensions and/or concaves in the surfaces thereof, and/or which comprise inclined surfaces, can be provided with a wrapper having an essentially uniform and trimmed appearance.

Other objects and advantages of the present invention will be brought out in the following part of the specification taken in conjunction with the accompanying drawings.

SUMMARY OF THE INVENTION

The invention is mainly based on the idea that by providing suitable movable backing means adapted to bring the wrapper material between two successive articles moved along conveyor means and subsequently to bear the wrapper against the front end of the article and at a later stage against the rear end of the article, and that by providing said apparatus further with suitable means for folding the wrapper material extending over the respective ends of the article against the sides thereof, said folding means being adapted to suit for various width and/or height dimensions, an arrangement is provided which is capable of enveloping differently dimensioned articles. The articles to be wrapped can vary in height and/or width and/or length.

More precisely, the method according to the present invention is mainly characterized by what is disclosed in appended claims 1 . . . 7 and especially by claim 1. The apparatus according to the present invention is mainly characterized by what is disclosed in appended claims 8 . . . 20 and especially by claims 8 and 18.

According to a preferred embodiment of the present invention the wrapper apparatus comprises conveyor means, which can be of any suitable type used to move articles, such as roller track, band or chain conveyor or similar. The conveyor path is adapted to pass through or by a wrapping station of the wrapping apparatus. The wrapping apparatus is also provided with a wrapper material source such as a wrapper material roll which is preferably disposed above the conveyor path and extends across the conveyor path.

The wrapping station further includes movable backing means arranged to bear the wrapper material against the front end and respectively the rear end of the article. Said backing means are also adapted to bring, preferably to draw, said wrapper material from the wrapper material source intermediate the ends of successive two articles to be wrapped such that the free end of the wrapper material web is positioned at a desired height from the conveyor means and relative to said front respective rear end of the article. Wrapper material cutting means of a suitable type are also provided in the wrapping station, preferably in connection with or adjacent to said backing means.

The preferred arrangement further comprises first folding means for folding a portion of the wrapper material extending over the width of the first end i.e. said front end of the article against the sides of the front end. Second folding means are provided for similar folding of the second, i.e. said rear end of the article.

According to a preferred embodiment, the apparatus further comprises means for applying adhesive to said foldings of the wrapper material or directly on the surface of article in positions, where the wrapper material and/or said foldings are contacting the surface of the article.

According to a further embodiment the apparatus comprises means for supporting portions of the wrapper sheet extending over the width of the article when the article is moved relative to the apparatus or alternatively the apparatus is moved relative to the article, and during the folding of the rear or front ends thereof.

According to another embodiment the folding means are disposed in connection with the backing means such that they form a part of the backing surface receiving one end of the article, or such that the backing surface is provided with suitable recesses for receiving the folding means. According to a further embodiment the folding means are of suitable planar structure and are adapted to form both the backing surface and the folding means.

According to a still further embodiment the means contacting the article during the folding procedure are constructed such that the contacting surfaces thereof will adopt the irregularities of the surface of the article. In such cases the backing means and/or the folding means can, for instance, be provided with a coating provided by a suitable foam rubber, rubber, cellular plastics or similar soft material. The folding means may also comprise suitable bristle-like roll means, drag means or suitable paddle means.

According to a further embodiment detector means connected to the control means of the apparatus are disposed closely adjacent to the apparatus, for example in connection with the conveyor means, to detect the dimensions and the position of the article. The detector means can be arranged such that some of them are detecting the required dimensions of the article while the others will detect the positioning thereof. It is also possible to have detector means detecting both the dimensions and the position of the article.

The wrapping apparatus according to the present invention may further include means for attaching the free end of the wrapper material web to the front end of the article, by which it is secured that the material web is properly drawn from the material source means as the article and the wrapper apparatus move relative to each other.

The foldings, i.e. the tongues as well the wrapper material portion extending over the width of the article can also be attached directly to the article. Means providing this are constructed such that it is possible to control the attachment procedure in a desired manner by the control means of the apparatus. Suitable means may comprise adhesive-applying means, such as various adhesive spraying arrangements or brush application means, stitcher means, taping means or similar. The apparatus may further comprise means for providing a desired amount of bands or strips around the wrapped article so that the wrapper is further fastened around the article. In addition, the apparatus may have means for providing corner shields or protections on top of the wrapper sheet or alternatively below the wrapper sheet.

According to an additional embodiment the arrangement comprises third folding means for a separate folding of the sides of the article after the ends thereof are folded. It is also possible to have one or several additional intermediate folding means for securing the folding of the sides of the article, especially in case the article is essentially long.

According to a still further embodiment of the invention the feeding and storage means of the wrapper material web, i.e. the wrapper material source, may comprise cutting means for longitudinal cutting of the web so as to adjust the width of the web to correspond with the width of the article to be wrapped. Furthermore, the apparatus may comprise means for moving and centering the web relative to the article after slicing a portion from one edge of the web. It is, of course, possible to cut a slice from both edges of the web. It is also possible to provide a material web source which comprises several rolls of material web, said rolls having different roll widths and/or including different types of wrapper material.

In operation, according to a preferred embodiment of the present invention, the wrapping or enveloping of an article initiates as the article, such as a bundle of lumber, enters a wrapping station. The front end of the article is engaged with backing means positioned in the path of travel of the article such that a free end of a wrapper material web drawn by said backing means from material source is sandwiched between the backing means and the article, whereby the front end becomes covered by the wrapper material.

Subsequently the backing means are removed and the folded portions of the front end extending over the width of the article are folded against the sides of the article by first folding means. The article is simultaneously moved ahead on the conveyor means, and the wrapper web is drawn by the article from the material source as the article forwards on the conveyor means.

After the article is totally covered with the wrapper sheet, the conveyor means are stopped for a moment, and said backing means is engaged with the rear end of the article such that the material web is between the backing means and the rear end of the article, and thus becomes folded against the rear end. The web is cut, and the side portions of the rear end are folded against the sides of the article by second folding means.

According to a further embodiment the dimensions and/or positioning of the article is detected by detector means operationally connected to control means of the apparatus.

According to one alternative the free end of the material web is attached to the front end of the article, for instance by means of adhesive or stitches. Furthermore, all foldings as well as the portions of the wrapper sheet extending in the sides of the article may be attached to the article in a similar manner.

In some instances it may be advantageous to support the side portions of the wrapper sheet extending over the width of the article on top thereof during the wrapping procedure and as the article moves ahead. The side portions are allowed to fall down and against the sides of the article after the end foldings are finished.

Several advantages are obtained by means of the present invention. The wrapping speed is increased and the amount of labor is decreased due to the remarkable increase in the degree of automation. The quality of wrappers is improved, and the wrappers are tight enough to withstand various stresses and damages common to loose wrappings. The article wrapped in accordance with the invention is provided with a neat and trimmed appearance. The wrapping method and automatic wrapping apparatus according to the invention is especially useful when wrapping essentially long articles having dissimilar dimensions, as is usually the case with lumber bundles or core board stacks, which had to be covered from five sides thereof only. The invention is even suitable for such long articles as pipes having essentially big diameter.

In the following the present invention and the other objects and advantages thereof will be described by way of an example with reference to the annexed drawings, in which similar reference characters throughout the various figures refer to similar features. It should be understood that the following description of an example of the invention is not meant to restrict the invention to the specific forms presented in this connection but rather the present invention is meant to cover all modifications, similarities and alternatives which are included in the spirit and scope of the present invention, as defined by the appended claims.

DETAILED DESCRIPTION OF THE DRAWINGS

Figure 1:
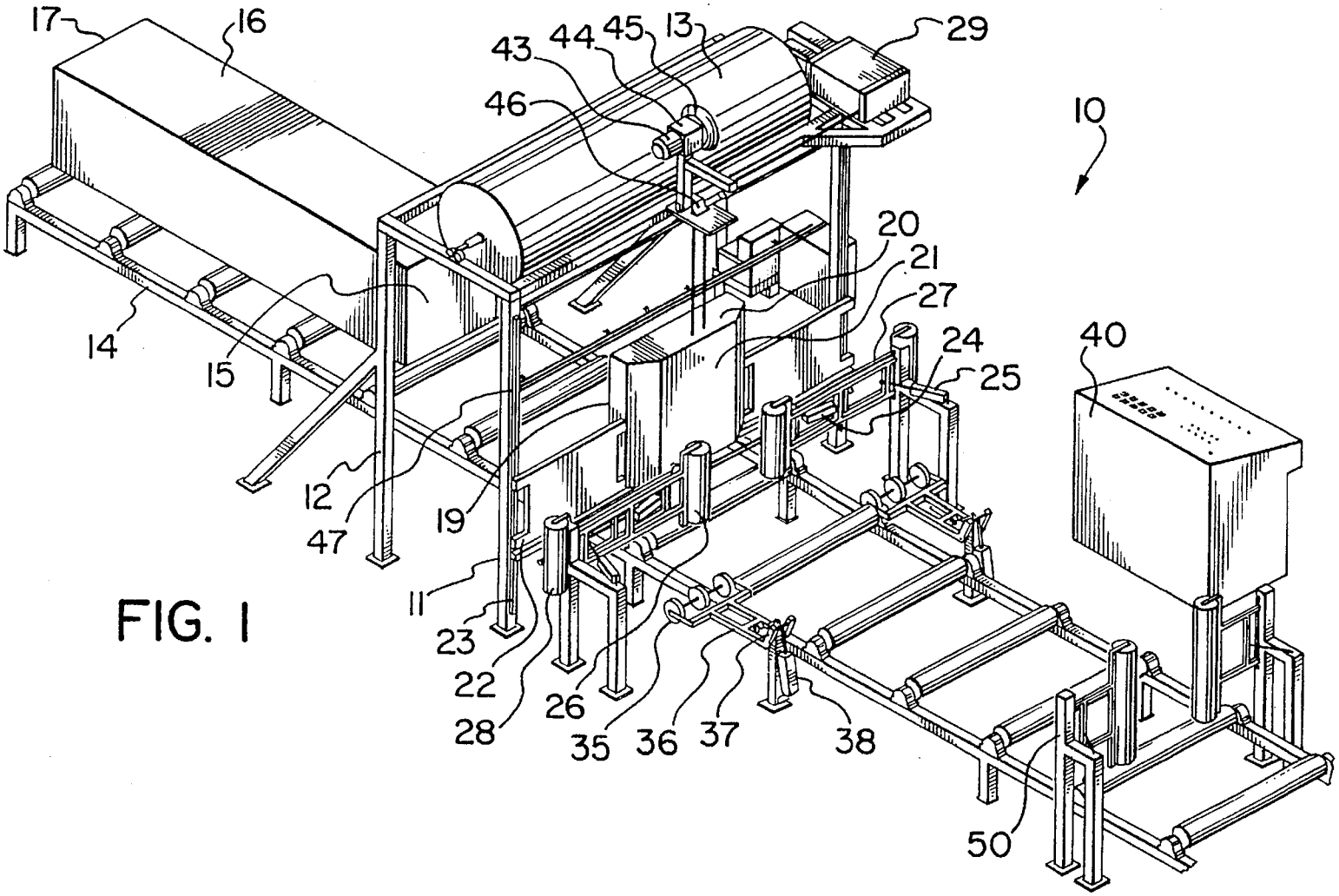
FIG. 1 is a schematic perspective view of an preferred embodiment of a wrapping apparatus according to the present invention.

A schematic perspective view of FIG. 1 discloses a preferred embodiment of the present invention. A wrapper apparatus generally designated by 10 comprises frame means 12, a web material roll 13, a roller track means 14 as a conveyor means, and a control desk 40. The article to be wrapped is designated by 16. For reasons of clarity, wrapper material web is not shown in FIG. 1.

According to the present invention, movable backing means 20 comprising first backing surface 19 and second backing surface 21 are provided. Said backing means 20 of FIG. 1 are supported by supporting means 22 and movable in up and down directions along guide tracks 23 mounted in the beam 11 of the frame means 12.

The drive means of the backing means 20 are described as a wire elevator 29, but any other means can be used for the raising and lowering of the backing means. The movement of the backing means can be provided, for example, by cylinder means, lift screws or similar. It should also be noted that the movement of the backing means 20 relative to the frame means 12 can be realized by various other means as well.

Folder means 26 and 28 for the folding of the web portions extending over the width of the article 16 in the front (first) end 15 and in the rear (second) end 17 thereof are also disclosed. Said pivotally assembled folder means 26, 28 are provided with drive means, such as cylinders 25, which operate the arms 27 thereof. The arms 27 are adapted to be swung from the initial position (see FIG. 3*a*) to a first operational position (see FIG. 3*b*) to initiate the folding of the tongues of the material web in the front end 15 of the article 16.

Figure 3A:
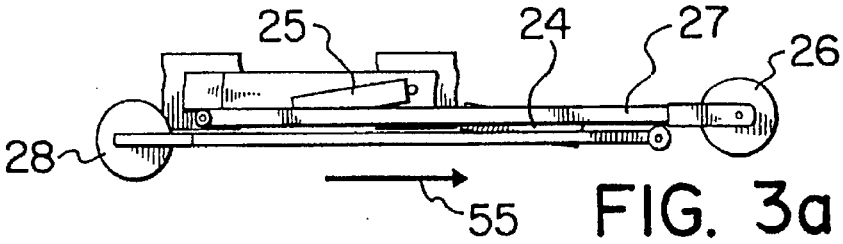
FIGS. 3*a*, 3*b* and 3*c* disclose schematically one possible embodiment of the folding means of the present invention in three operational positions thereof.

In the embodiment shown in FIGS. 1 and 3*a*, *b* and *c* the first and second folding means 26 and 28 are arranged as one assembly. Thus the folding means further include second drive means, such as cylinder 24, which are adapted to swing the folding means to a second operational position thereof (see FIG. 3*c*) such that the folding of the material web tongues in the rear end 17 of the article 16 is made possible.

The source of the wrapper material web comprises a roll means 13. FIG. 1 further shows drive means 44 comprising a runner 45 adapted to gently follow the roll surface, drive motor means 43 which preferably rotate in two directions, and means 46 controlling the position of the drive means and the force applied towards the roll surface by the runner 45. Said drive means 44 are preferably arranged such that the tension of the material web is controllable by them as well as such that the material web can be discharged from and drawn back on to the roll 13 by drive means 44, Adhesive application means 47 are also disclosed. However, they are discussed in more detail in connection with FIG. 5.

Wrapper sheet supporting means 36 are also shown, said means being positioned in the lower operational position thereof. In the example said means 36 comprise roller means 35, swivelling arm means 37 and drive means 38. Spaced roller means 35 are especially advantageous when an adhesive stripe or stripes are applied on the lower side of the wrapper material sheet so as to attach the sheet on the sides of the article 16, whereby the stripes may run between the rollers without any risk of gripping on the rollers. The other suitable supporting arrangements are, for instance, different slide surfaces, beams, rods and similar means suitable for the supporting of a moving wrapper sheet.

Furthermore, FIG. 1 discloses third folding means 50, which are provided to secure that the wrapper sheet becomes in a desired and firm manner folded also in the sides of the article 16.

Even though not shown, the apparatus according to the present invention usually comprises detector means for detecting the position and/or dimensions of the article 16. The detector means are preferably operationally connected to the control means 40 of the apparatus 10, as are also all the moving parts of the apparatus in common. The skilled man is familiar with this kind of detecting devices as well as with suitable control means, and therefore they are not discussed in more detail.

Figure 2A:
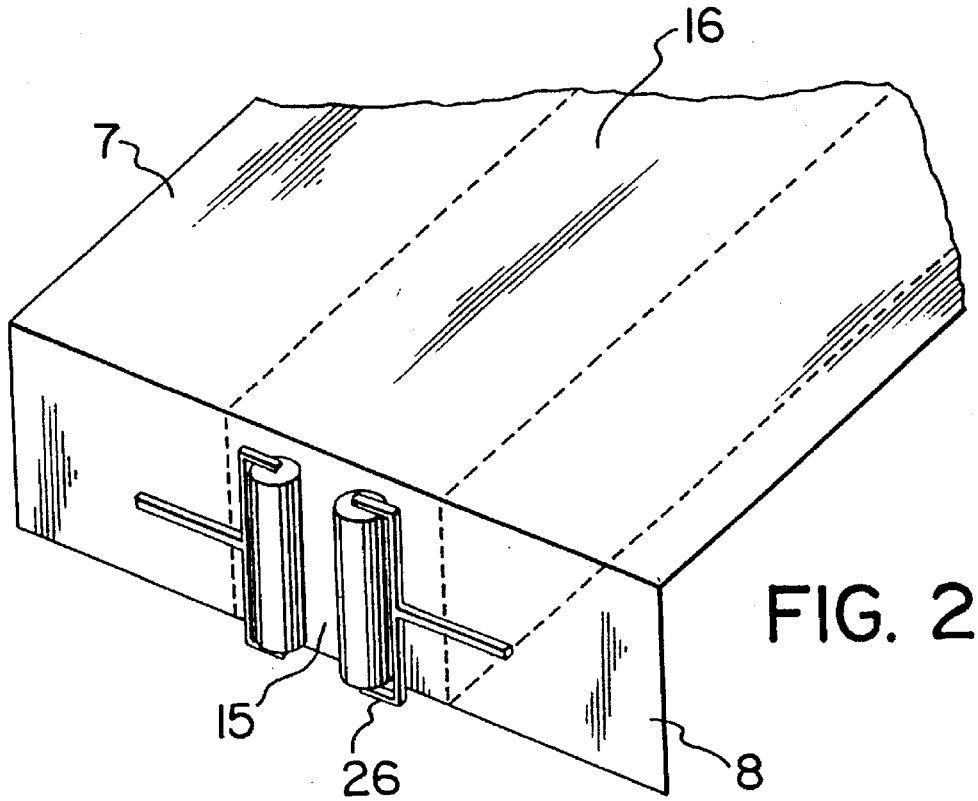
FIGS. 2*a* and 2*b* are a schematic perspective views of the operational principles according to one preferred embodiment of the present invention.
Figure 2B:
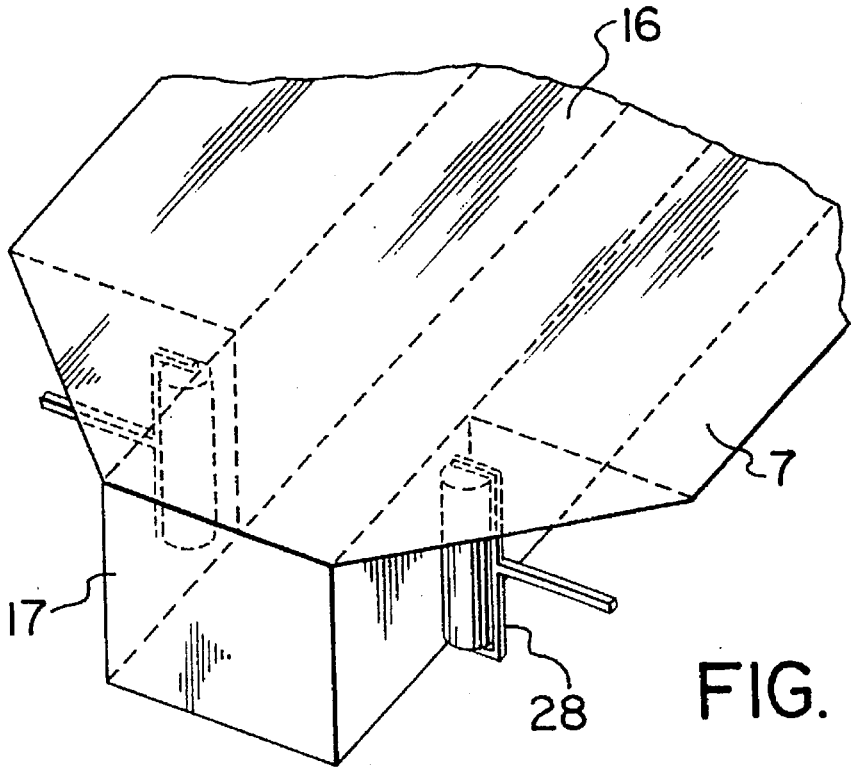

FIG. 2*a* shows schematically the situation in which the backing means is removed from the engagement with the front end 15 of the article 16 and the first folding means 26 have been moved to their operational position against the front end 15. The folding of the "free" portion 8 of the material sheet extending over the width of the article is shown in FIG. 2*b*, in which the article has moved ahead in the conveyor and the folding means 26 have moved from the front end to the sides of the article and folded the sheet portion 8 against the sides of the article. The folding means 26 can alternatively be arranged to be movable instead of article 16, or each can be simultaneously moved relative to the other.

According to one preferred embodiment the folding of the second i.e. the rear end 17 of the article is arranged in a similar manner, but by providing the movement of the article 16 on the conveyor means in backwards direction.

As can be noted from FIGS. 2*a* and 2*b*, the width of the article does not have a key role in view of the folding, since the folding means do always function in the same manner independently from the article width. Thus the only parameters setting limitations to the article width are the width of the conveyor and the width of the frame means of the apparatus. The folding means are also well suited for the folding of articles having different heights. In some cases it is even possible to replace the rolls of the folding means to shorter or longer ones, and thus provide a new range of possible heights of articles to be wrapped.

FIGS. 3*a, b* and *c* show folding means corresponding to those already shown in FIG. 1. In this preferred arrangement the front end folding means 26 and the rear end folding means 28 are mounted into the same pivoting arm 27. By this it is possible to achieve a more simple construction and easier control of the folding means.

The conveyor means 14 as well as the article 16 are shown schematically. Arrow 55 shows the general direction of movement of the article 16 relative to the folding means. In this example the folding means comprise rotatably assembled rollers 26 and 28 which are arranged to bear against the end and side portions of the article.

In FIG. 3*a* the folding means assembly is in an initial position thereof, thereby allowing the article to pass it.

Figure 3B:
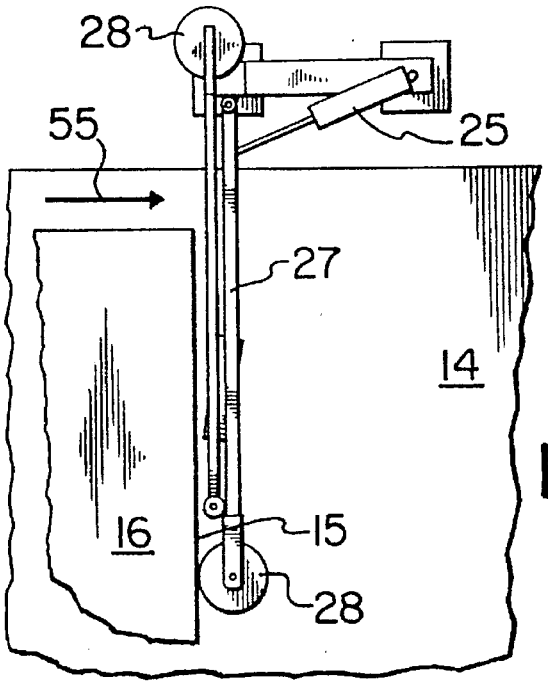

In FIG. 3*b*. the first folding means 26 is turned to a position in which the folding of the front end 15 is initiated (see FIG. 2*a*). The arrangement is such that as the article forwards, the arm 27 turns in the direction 55 of movement and finally the folding means will enter around the corners of the article to the sides thereof and continue the folding of the wrapper sheet in the sides (see FIG. 2*b*). The cylinder means 25 is arranged to bias the folding means by a desired force, but also to allow the arm to turn as the article 16 moves ahead on the conveyor 14.

Figure 3C:
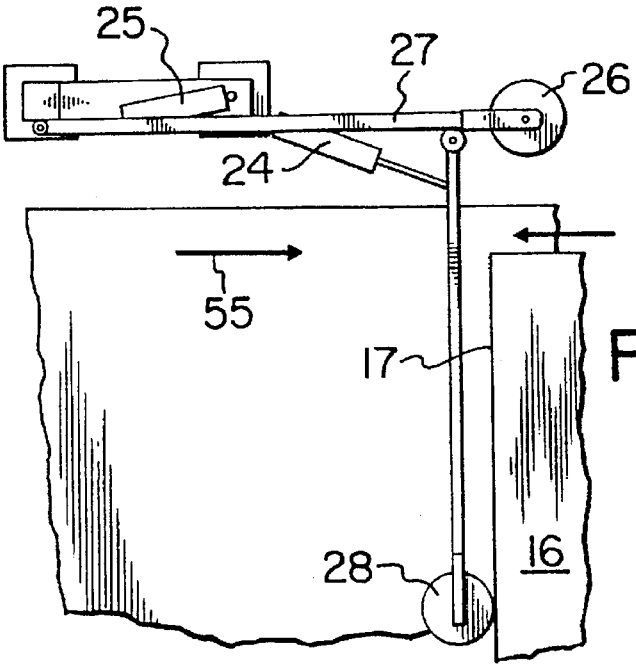

In FIG. 3*c* the second i.e. the rear end folding means 28 are turned to a position in which the rear end 17 of the article 16 is received and the folding thereof is initiated. When operating with this type of folding means, the article 16 is at this stage moved backwards, i.e. against the general direction 55 of movement. Thus the operation of the second folding means 28 is in principle similar to the first folding means 26.

It should be noted that by providing a suitable arm means and control means and/or cylinder means one single folding roller means can be adapted to perform the folding in both ends of the article. However, the construction disclosed in FIGS. 3*a, b* and *c* is at the moment considered to be the most simple and practical arrangement.

The outer periphery of the roller means 26 and 28 can also be formed to be flexible, for instance by bristles, whereby the folding of uneven, irregular and/or inclined surfaces or articles not accurately positioned relative to the apparatus is facilitated. Correspondingly, a suitable elastic surface, such as cellular plastic, foam rubber or similar can be used on the rollers.

Figure 4:
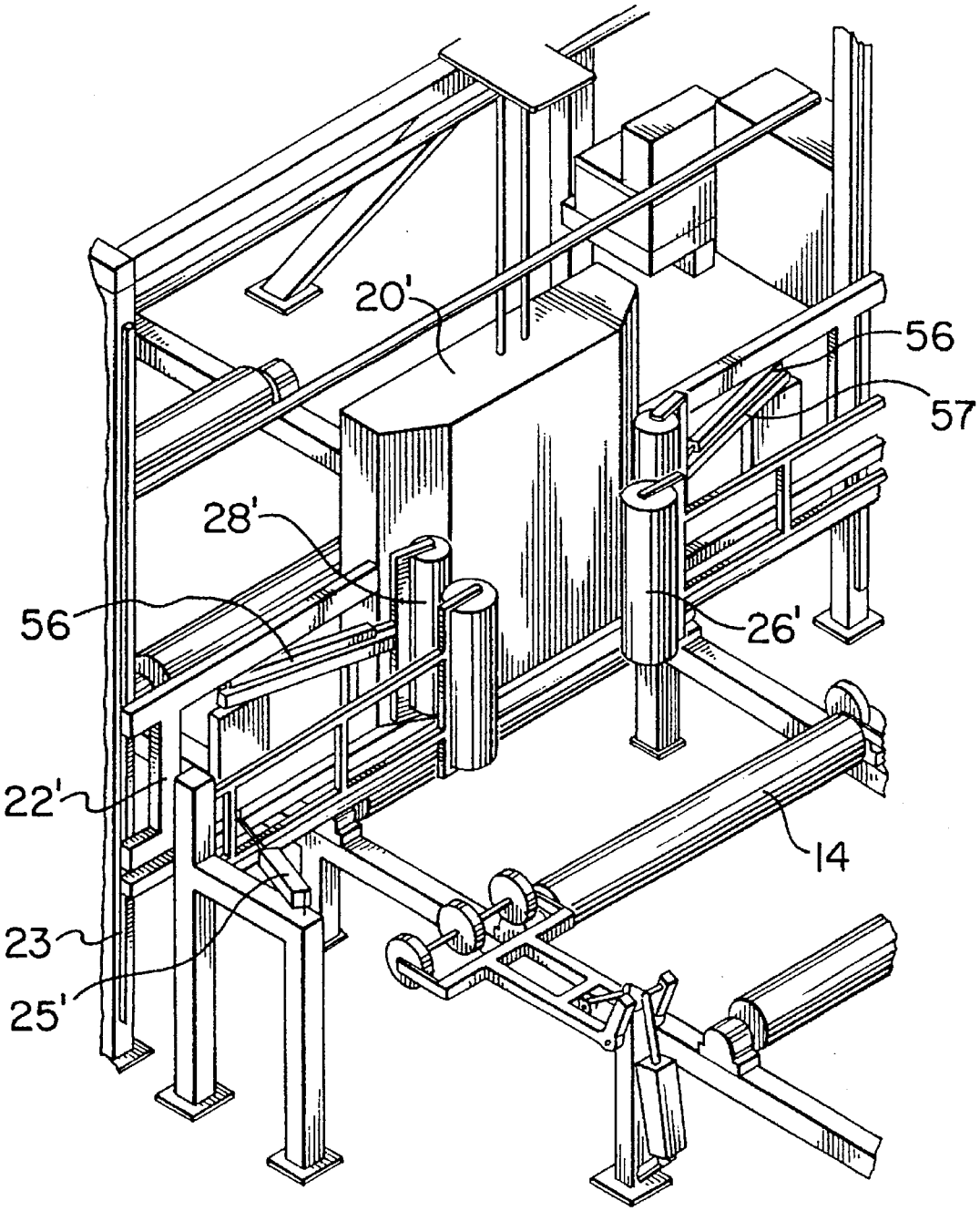
FIG. 4 is a schematic perspective view of an alternative embodiment of the folding means of the present invention.

FIG. 4 discloses an alternative embodiment of the folder means and backing means according to the present invention. The front end folding means 26' are arranged to operate in an essentially similar manner to the above described means 26. The second i.e. the rear end folding means 28', however, are pivotally mounted on the supporting means 22' of the backing means 20'. A pair of the rear end folding means 28' is arranged in connection with the backing means 20' such that they are received by the recess of the backing means 20' surface as the rear end of the article is pressed and folded by said backing means. Cylinder means 56 are arranged to move the folding means 28' such that they move in the direction of the arm 57 away from each other when a pair of folding means bears against the end surface of the article, and after having received the corner of the end surface they will again be pushed by means 56 and move along the sides of the article, whereby the foldings of the rear end are facilitated.

Figures 5, 6:
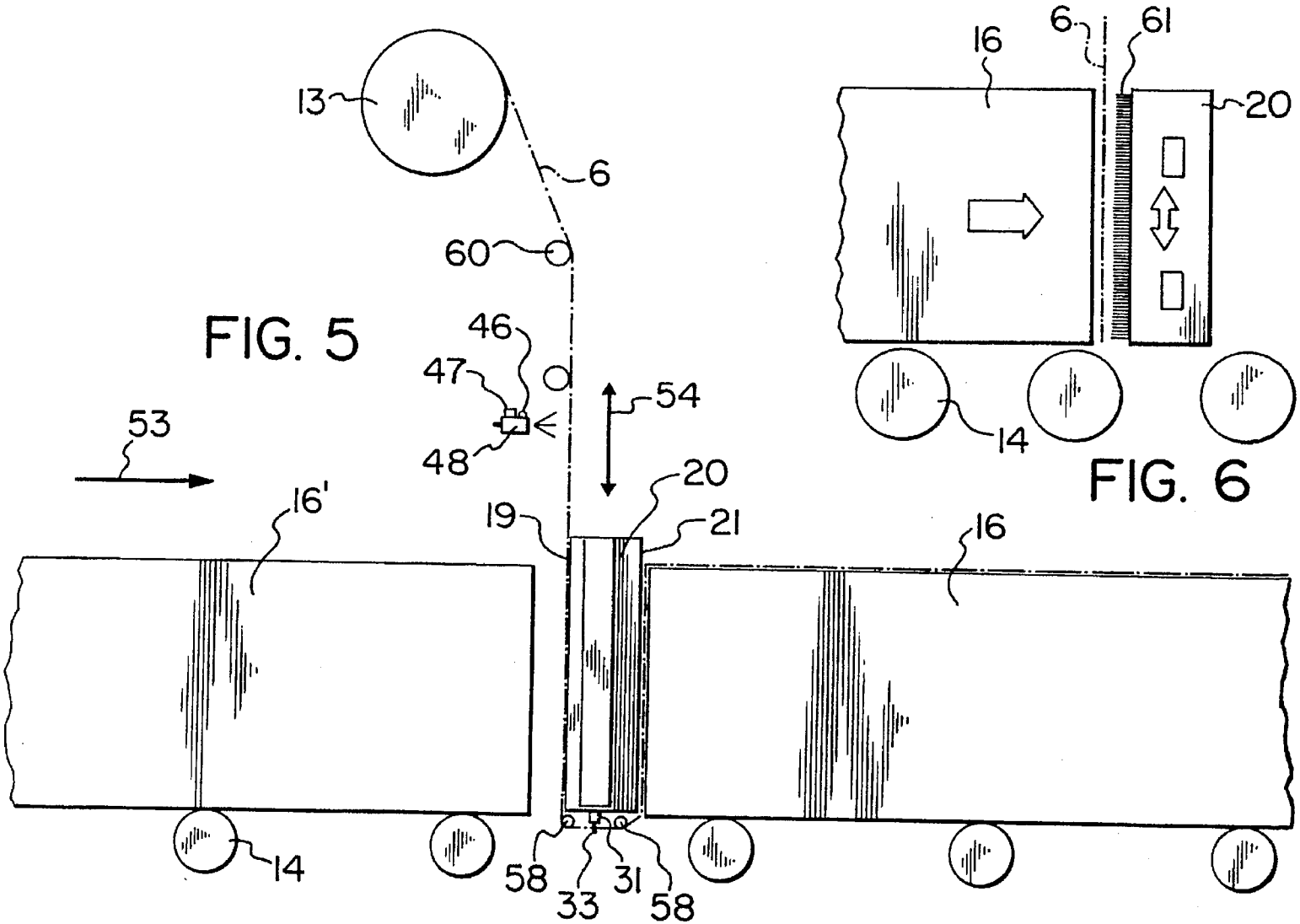
FIG. 5 shows the operational principle of the preferred embodiment of the present invention.
FIG. 6 shows an alternative to the embodiment of FIG. 5.

The schematic presentation of FIG. 5 discloses one embodiment of the movable backing means 20 and the operation thereof in more detail. The backing means 20 include both first and second backing surfaces, 19 respective 21, positioned in the opposed sides thereof. In FIG. 5 the backing means 20 are shown in the lower operational position thereof between two successive articles 16 and 16' such that the second backing surface 21 is bearing against the rear end of article 16 and the front end of article 16' is about to engage the first backing surface 19.

The material web 6 is arranged to be drawn from the roll 13 by the downwards movement of the backing means 20 and subsequently by the movement of the article 16 in direction 53. The web path is provided with necessary guiding means, such as 58 and 60. In addition, the guiding bars 58 (or in some cases guiding rollers) are adapted to press the material web 6 against the top surface of the article as it passes under the backing means 20.

FIG. 5 further discloses blade means 33 and drive means 31 thereof assembled on the bottom portion of the backing means 20. These cutting means are about to initiate the cutting of the material web 6. In the present example said blade means 33 is driven by an armless cylinder 31. The skilled person, however, understands that the cutting means can be arranged in various other manners as well.

FIG. 5 shows clearly the advantages obtained in concern of the setting of a right material web length, even if the height and length of the article 16 or 16' varies from article to another. Especially evident is that the end of the material web 6 is always at a desired height, even if the heights of the subsequent articles 16 and 16' were different.

FIG. 5 discloses also means 46 for the application of an adhesive directly to the surface of the material web 6. Means 46 usually comprise adhesive source means (not shown), distribution channels 47 and nozzle means 48. In the experiments performed this far it has been found that a preferred number of nozzle means is five, the positioning of them being such that three of them apply adhesive stripes with desired spacing to the middle portion of the web 6, i.e. to the portion covering the ends and the top of the article, while two of the nozzles are adapted to spray an adhesive stripe on each side portion of the web 6, for example about 10 to 30 centimeters from the edge thereof. However, other numbers and positions of the nozzle means are also possible. The adhesive can also be applied with some other type of means and/or directly on the surfaces of the article.

Said nozzle means 48 are preferably operationally connected to the control means, so that various parameters like the time and pressure of spraying, number of nozzles used and so on can be adjusted in a desired manner, whereby savings in consumption of the adhesive is obtained and it is secured that the adhesive will not be applied to places where it is not necessary or might even be harmful.

FIG. 6 discloses an alternative backing means provided with at least one flexible backing surface, such as a bristle surface 61, adapted to receive any irregularities in the end surface of the article 16.

Figure 7:
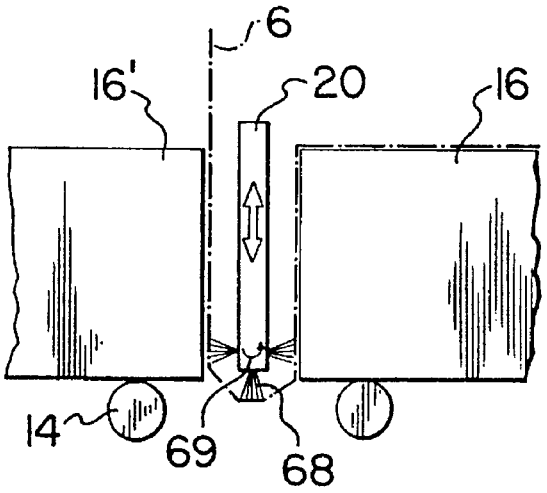
FIGS. 7 and 8 are schematic views of one alternative structure of the backing means according to the present invention, showing the operation thereof.
Figure 8:
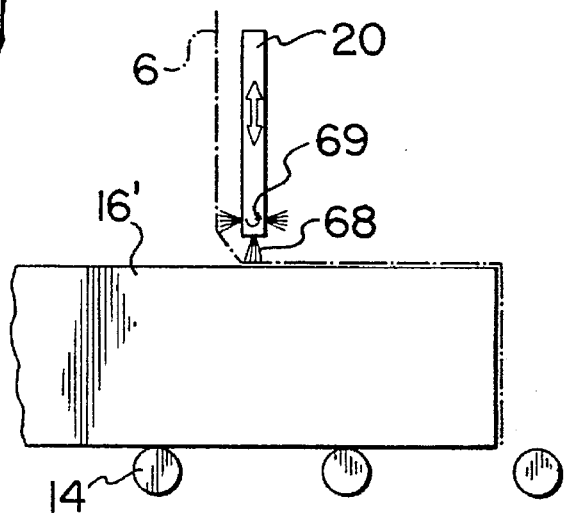

FIGS. 7 and 8 disclose backing means 20 provided with bristle means 68 arranged to guide the material web 6 and also to bear the web against the top surface of the article 16'. According to a further solution, there is only one row of bristles and it is adapted to be movable between different positions in a manner shown by arrow 69.

Figure 9:
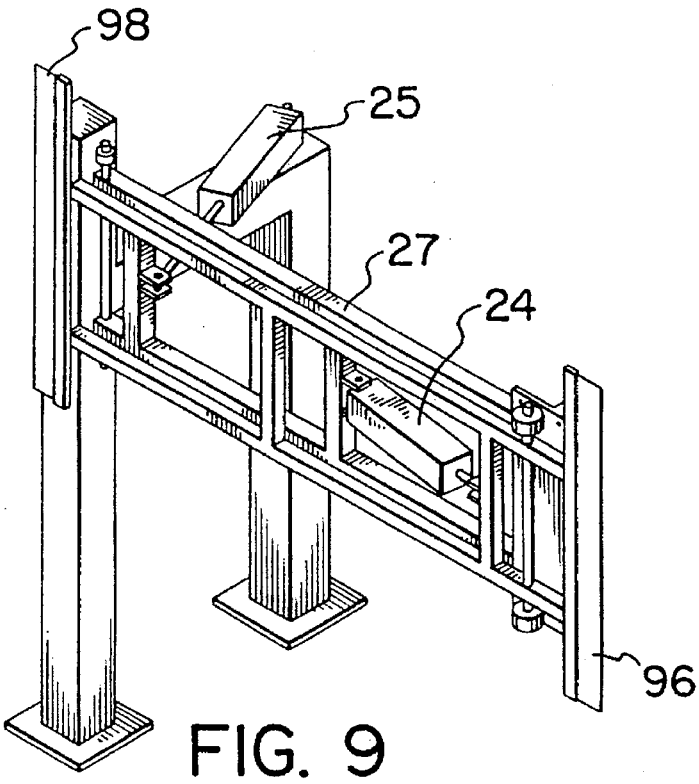
FIG. 9 is a perspective view of a further embodiment of the folding means.

FIG. 9 discloses alternative folding means 96 and 98. Said folding means generally correspond to those shown in FIGS. 3*a, b* and *c*, but are provided with suitable sliding means, such as plastic blades or doctors or suitable bristles or slide shoes, or special plate means provided with a plurality of small rollers or balls.

In operation, according to a preferred embodiment of an automatic wrapping device according to the present invention, the wrapping of an article 16 is initiated as it enters to a wrapping station 10 along a conveyor means 14. A free end of a wrapper material web 6 discharged from a material source, such as a material roll 13, is disposed closely adjacent to a first backing surface 19 of backing means 20. The front end 15 of the article 16 on the conveyor engages said surface 19, and thus the web 6 is sandwiched between the surface 19 and the front end 15.

The free end is preferably attached to the front end, for example by means of an adhesive applied to the web or to the surface of the article, stitches, a tape or similar means. Also mechanical holding means can be used to hold the free end of the web 6 attached to the front end 15. However, it should be noted that it is not always necessary to have any kind of attachment of the free end.

The backing means 20 is lifted up such that it is possible for the article 16 to pass under it. The article is then moved ahead on the conveyor 14, while the top surface thereof is preferably pressed by suitable bearing means 58, 68 disposed in the bottom of the backing means, whereby more wrapper material is drawn from the roll 13 and placed on top of the article.

It might be necessary to cut a slice of one or both edges of the wrapper material web to fit it with the width of the article. According to another embodiment, the desired material web width is selected amongst a plurality of material sources containing material webs of different widths.

First folding means preferably comprising an opposed pair of folding rolls 26 or similar are turned into an operational position thereof to receive the front end 15, as is shown in FIG. 2*a*. The folding means 26 follow the surface of the front end 15 such that as the article 16 moves forward the folding means depart from each other and finally turn around the front side corners of the article and will continue the relative movement in the side surfaces of the article, thereby folding the tongues 8 extending over the width of the article against the sides of the article 16. Thus the portion of the width of the material web is pressed against the sides, and if desired, is attached thereon by adhesive or other means of attachment previously described. The wrapper material used may also be stiff enough to retain the folded position thereof without any additional means of attachment.

The article is then forwarded on the conveyor until the other, i.e the rear end reaches and passes the backing means 20, whereby the backing means are lowered and the rear end 17 of the article is engaged with the second backing surface 21. In some cases it might be necessary to slightly reverse the article to obtain the required pressing force between the rear end 15 and the backing surface 21.

Supporting means, like 36 in an uplifted position, may be used to support the material web extending over the width of the article on the sides thereof such that it will not drop towards the sides of the article as the article is forwarded on the conveyor and the ends are folded. In case stripe or stripes of adhesive are applied on the material web, such stripes will run in spacings between support rollers 35.

After the backing means 20 is moved back to the lower position thereof, and the article is covered with the wrapper sheet from the both ends and the top thereof, it is advantageous to slightly rotate the material roll 13 backwards by drive means 44 so as to tension the web 6. The tensioning is made to secure that there are no looseness in the wrapper and especially to facilitate the cutting thereof by cutting means 33 disposed beneath the backing means. The subsequent article 16' may have been moved against the first backing surface 19 subsequent to said tensioning but prior to the cutting of the web.

Said by wrapper material covered article 16 is further forwarded on the conveyor 14, and second folding means 28 are placed against the rear end 17 thereof, which will then fold the rear end 17 otherwise in a similar manner to the folding of the front end 15, but such that the article is now moved backwards on the conveyor as much as is necessary to fold the rear end.

According to one alternative, the folding of the rear end 17 is effected by folding means 28' arranged to be driven such that it is not necessary to move the article during the folding of the rear end. For example, the pivoting arm 57 of the folding means in FIG. 4 may be provided with suitable cylinder means 56, the arrangement being such that the folding means at the ends of the arms can be moved, i.e. the length of the arms 57 can be changed. Thus the folding means 28' can be moved away from each other in contact with the rear end 17 as the cylinder means 56 are drawn in and subsequently moved in contact with the sides as the cylinder means 56 are pushed out, whereby the web becomes folded in the rear end of the article.

As the ends are folded, supporting means 35 is removed, whereafter the side portions 7 of wrapper sheet extending over the width of the article fall against the sides of the article. In some cases it is necessary to press the wrapper material tightly against the sides by suitable post-folding or side-folding means, such as 50 in FIG. 1. In case adhesive is applied on the wrapper or self-adhering wrapper is used, the wrapper will attach firmly to the article. In some cases it is preferred to apply the adhesive directly on the article.

Furthermore, suitable stitching means, taping means or similar means and/or banding means may be used to ensure the wrapping.

Thus, the invention provides an apparatus and a method by which a significant improvement in the area of wrapping or enveloping of an article is achieved. The wrapping is fully automatic and fast to perform. The apparatus and method according to the present invention provides a possibility to flexibly wrap articles of different sizes, even such that the subsequent articles need not to be similarly sized. The apparatus is simple in construction, but has many-sided functions, is fast and reliable in operation and produces uniform wrappers.

It should be noted that the foregoing examples of the embodiments of the invention are not intended to restrict the scope of the invention defined in the appended claims. For instance, upon reading the above description together with the annexed drawing it will be obvious to the skilled person to use a movable wrapping apparatus for wrapping of non movable articles. In addition, it will be clear to the skilled person that an article can be wrapped from all sides thereof by providing the apparatus with two wrapper material sources such they are placed on the opposite sides of the article. Furthermore, it is not necessary to have the wrapper material source disposed on top of the article, but the source may be positioned on either side of or even below the article.

We claim:

1. A method for wrapping of an article having essentially parallelepiped shape with a web-like wrapper material emerging from wrapper material web source means, comprising the steps of:

disposing a backing surface means against the first end of said article such that said wrapper material web is sandwiched between said first end and said backing surface means, holding said wrapper material web in said first end, providing a relative movement between said article and said wrapper material web source means such that said wrapper material web is discharged from said wrapper material web source means and placed on at least one surface of said article during said relative movement, folding the portions of said wrapper material web extending over the width of said first end of said article around the edges of said first end and against the corresponding sides of said article by suitable folding means, disposing a second backing surface means against the second end of said article such that said wrapper material web extending from said first end over the length of said article is further discharged from said wrapper material web source means and such that it becomes disposed between said second end and said second backing means surface, cutting said wrapper material web to a desired length, folding the portions of said wrapper material web extending over the width of said second end of said article around the edges of said second end and against the corresponding sides of said article by suitable folding means, and disposing the portions of said wrapper material web extending over the width of said article between said first and second ends thereof against the respective sides of said article.

2. A method according to claim 1, wherein said backing surface means is moved to the path of travel of said article by lowering said backing surface means and that said backing surface means is removed by lifting it off from said path of travel so that it is possible for said article to pass under said backing surface means, and wherein said wrapper material sheet is drawn from said wrapper material source means by means of said movement of said backing surface means and relative movement between said article and said wrapper material source means.

3. A method according to claim 2, wherein suitable bearing means mounted in connection with said backing surface means bears said wrapper material web against the top surface of said article as said article moves under said backing surface means.

4. A method according to claim 1, wherein said wrapper material web is held in connection with said first end by attaching the end of said wrapper material web to said first end of said article by means of an adhesive, taping, nails or stitches.

5. A method according to claim 1, wherein the foldings of said wrapper material web are held in said sides of said article in the first and second ends thereof by attaching said foldings by means of an adhesive, taping, nails or stitches.

6. A method according to claim 1, including further steps of:

supporting said web portions between said first and second ends extending over the width of said article such that during said relative movement and said foldings in respective ends of said article the falling down of said web portions against the sides of said article is prevented, and removing said support after said foldings in respective ends are finished.

7. A method according to claim 1, including a further step of detecting at least one of the dimensions of said article and/or the position thereof.

8. An apparatus for wrapping of an article having an essentially parallelepiped shape by a web like wrapper material, said apparatus comprising in combination:

wrapping station frame means, conveyor means for moving said article, said conveyor means being arranged such that the path of travel extends through said wrapping station, wrapper material source means, movable backing means for pressing said wrapper material web against the first and second ends of said article, drive means provided to move said backing means against and away from said first end and said second end, first end folding means for the folding of the portions of said wrapper material web extending over the width of said first end around the edges of said first end and against the respective sides of said article, second end folding means for the folding of the portions of said wrapper material web extending over the width of said second end around the edges of said second end and against the respective sides of said article, cutting means for the cutting of said wrapper material web, and means for disposing the portions of said wrapper material web extending over the width of said article between said first and second ends against the respective sides of said article.

9. An apparatus according to claim 8, wherein said backing means comprise first and second backing surface means such that said second surface means is on the opposite side relative to said first surface means, said backing means being arranged to be lifted and lowered by said drive means such that in the lower operational position thereof said backing means is disposed in the path of travel of said article on said conveyor means, and that in the upper operational position thereof said article is allowed to pass under said backing means, and said backing means is adapted to draw said wrapper material web from said wrapper material source means, such that a desired amount of said wrapper material web is provided into the respective ends of said article.

10. An apparatus according to claim 8, wherein cutting means are mounted below said backing means such that said wrapper material web is arranged to be cut intermediate to said first and second backing surface means.

11. An apparatus according to claim 8, wherein it further includes means for applying an adhesive, said means being disposed either such that a desired amount of said adhesive is applied on the surface of said wrapper material web placed towards said article or such that a desired amount of said adhesive is applied on the surface of said article, said adhesive being preferably applied in a form of adhesive stripes.

12. An apparatus according to claim 8, wherein it further includes supporting means for controlled supporting of the portions of said wrapper material web extending over the width of said article between the respective ends thereof, said supporting means having at least two operational positions.

13. An apparatus according to claim 8, wherein said first end folding means and said second end folding means both comprise pivoted arm means, folding roll means assembled on said arm means and arranged to bear said wrapper material web towards the respective surfaces of said article during the folding procedure, and cylinder means for a controlled turning of the arm means and for biasing said folding roll means against said article during the folding procedure.

14. An apparatus according to claim 13, wherein said first end folding means and said second end folding means are provided as an integrated assembly such that said arm means of said second end folding means are pivotable assembled on the pivoted arm means of said first end folding means, whereby the arrangement is such that said two folding means are arranged to fold and bias said wrapper material web in the respective end each, said two folding means having an opposite direction of biasing.

15. An apparatus according to claim 8, wherein at least one of said first end folding means and second end folding means or means disposing said web on the sides of said article are provided with an elastic folding surface, said elastic folding surface being preferably provided by means of bristles, cellular plastic or foamed rubber formed in a shape of a roll or by means of elastic paddle means.

16. An apparatus according to claim 8, wherein at least a portion of said backing means bearing against said article is provided with an elastic surface, such an elastic surface preferably being provided in a form of bristle means, cellular plastic or foamed rubber.

17. An apparatus according to claim 8, wherein it further comprises means for controlling the tightness of said wrapper material web emerging from a wrapper material web roll of said wrapper material source means, said controlling means including a rotatable runner means arranged to rotate said roll, drive means for rotating said runner means, preferably arranged to rotate said roll in two directions, and means for controlling the rotational force applied to the roll and the position of said controlling means.

18. An apparatus for a continuous wrapping of variously sized successive articles by a web like wrapper material, said articles having an essentially parallelepiped shape, said apparatus comprising in combination:

wrapping station frame means, conveyor means for moving of said articles, said conveyor means being arranged such that the path of travel extends through said wrapping station, wrapper material source means, movable backing means for pressing of said wrapper material web against the first and second ends of said articles, said backing means being arranged to be moved between the ends of two successive articles, drive means to provide the movement of said backing means, first end folding means for the folding of the portions of said wrapper material web extending over the width of said first end around the edges of said first end and against the respective sides of said articles, second end folding means for the folding of the portions of said wrapper material web extending over the width of said second end around the edges of said second end and against the respective sides of said articles, cutting means for the cutting of said wrapper material web between the successive articles, and means for disposing the web portions of said wrapper material web between said first and second ends and extending over the width of the article against the respective sides of said article.

19. An apparatus according to claim 18, wherein it further includes detecting means for the detecting of the dimensions and/or positioning of said articles, said detecting means being preferably operationally connected to the control means of said apparatus.

20. An apparatus according to claim 18, wherein said wrapper material source means further include means for altering the width of said wrapper material web according to the dimensional requirements of an article to be wrapped, said means preferably including means for cutting a slice from at least one edge of said wrapper material web or means for selecting a material web having desired width from a plurality of material webs having different widths.

* * * * *